US006421924B2

(12) United States Patent
Anderson et al.

(10) Patent No.: US 6,421,924 B2
(45) **Date of Patent: *Jul. 23, 2002**

(54) CUSHION BACK CARPET CUTTING TOOL

(75) Inventors: Martin L. Anderson, Maple Lake, MN (US); Raymond N. Taylor, Signal Mountain, TN (US)

(73) Assignees: National Carpet Equipment, Inc., Brooklyn Park, MN (US); Textile Rubber & Chemical Company, Inc., Tiarco, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/481,829

(22) Filed: Jan. 12, 2000

Related U.S. Application Data

(60) Provisional application No. 60/116,707, filed on Jan. 22, 1999.

(51) Int. Cl.[7] ..... B26B 29/00

(52) U.S. Cl. ..... 30/294; 30/287; 30/305; 30/314

(58) Field of Search ..... 30/280, 282, 283, 30/289, 279.2, 299, 304, 305, 317, 287, 294

(56) References Cited

U.S. PATENT DOCUMENTS

| | | | | | |
|---|---|---|---|---|---|
| 2,186,429 | A | * | 1/1940 | Reinwald | 30/304 |
| 2,238,678 | A | * | 4/1941 | Cook | 30/294 |
| 2,962,816 | A | * | 12/1960 | Glotzer | 30/304 |
| 3,009,247 | A | * | 11/1961 | Mueller | 30/294 |
| 3,337,955 | A | * | 8/1967 | Poletajev | 30/294 |
| 3,488,843 | A | * | 1/1970 | Tims, Jr. | 30/162 |
| 3,543,400 | A | * | 12/1970 | Scott et al. | 30/280 |
| 3,543,401 | A | | 12/1970 | Scott et al. | 30/294 |
| 4,001,936 | A | * | 1/1977 | Matsushita | 30/287 |
| 4,064,627 | A | * | 12/1977 | Zanfini | 30/287 |
| 4,095,341 | A | * | 6/1978 | Crain | 30/287 |
| 4,620,368 | A | * | 11/1986 | Bowman | 30/294 |
| 4,833,956 | A | * | 5/1989 | Roberts | 30/287 X |
| 5,740,614 | A | * | 4/1998 | Carder et al. | 30/293 |
| 5,881,463 | A | * | 3/1999 | Casteel et al. | 30/280 |
| 6,112,417 | A | * | 9/2000 | Hyer et al. | 30/290 |

* cited by examiner

*Primary Examiner*—Boyer Ashley
(74) *Attorney, Agent, or Firm*—Nikolai & Mersereau, P.A.

(57) ABSTRACT

The cushion back carpet cutting tool is a hand tool for cutting foam back carpeting that creates a clean straight cut through the carpeting so that a smooth unnoticeable seam results where two pieces of carpet material are brought together. The tool includes a leading edge on the center plate that opens the adjacent rows of tufts in the carpeting, three blades for cutting the carpeting between adjacent rows either close to the right row of tufts, left row of tufts or midway between the tufts, three plates that retain the blades and an adjustable retainer system for the blades, and a handle. The leading edge has an angle of less than 90 degrees from the horizontal and is rounded in shape to prevent loop or woven carpeting from catching on the tool, and also to keep the tool from jumping out of the row where the cut is being made. The blades are kept in place at an angle of between 15 to 25 degrees from the bottom edge of the tool, which results in a smoother cut being made in the carpeting. The amount that the blades extend downward is adjustable to accommodate different thicknesses of carpeting.

12 Claims, 3 Drawing Sheets

CUSHION BACK CARPET CUTTING TOOL

CROSS-REFERENCE TO RELATED APPLICATION

The present application constitutes a utility application for Letters Patent to that certain Provisional Application Ser. No. 60/116,707, filed Jan. 22, 1999 of Martin L. Anderson, entitled "CUSHION BACK CARPET CUTTING TOOL."

BACKGROUND OF THE INVENTION

I. Field of the Invention

This invention relates generally to hand tools used by carpet installers, and more particularly to an improved tool for creating a clean straight cut through the thickness dimension of foam back carpeting so that a smooth unnoticeable seam results where two pieces of the carpet material are brought into edge wise abutment.

II. Discussion of the Prior Art

The Scott et al. U.S. Pat. No. 3,543,401 describes a cushion back carpet cutter that has left-hand and right-hand blades for selectively cutting close to tufted piles on the left and right sides of the spaces between adjacent rows of tufts. It comprises a guide having a longitudinal edge for engaging the top surface of carpet backing between adjacent rows of tufts and a leading edge that meets the longitudinally extending edge at an angle of 90°. The guide plate is sandwiched between two retaining plates and a handle is attached to the retaining plates at an upper edge thereof to facilitate grasping of the tool during use.

Formed inwardly of the longitudinal edge of the guide plate is an inclined blade notch that is disposed at an acute angle of about 30° to the longitudinal edge of the guide plate. A pair of rectangular blades, each with a razor-sharp honed edge, is disposed within the blade notch in the guide plate in side-by-side relation, allowing either the left or the right blade to be extended relative to the longitudinal edge of the guide plate and then clamped by a thumb screw and nut to hold their position within the blade notch.

While the cutter made in accordance with the Scott et al. patent works satisfactorily with some cushion back carpet materials, it has been found that it suffers from a number of draw-backs when attempts are made to use it with newer polyurethane backed carpet materials. A 30° blade angle has been found to create frayed, jagged edges on the polyurethane layer that makes it difficult for an installer to bring two edges into contact without seeing a noticeable line at the seam. Also, when using the prior-art Scott et al. carpet cutting tool, it is first necessary to use a separate, row-opening tool to provide a space for entry of the cutting tool's guide plate. Further, the relatively large radius of the nose frequently results in the tool jumping out of a row as the operator attempts to push the tool along that row. Then, too, the 90° angle between the leading edge of the guide plate and the longitudinal, carpet-engaging edge resulted in frequent catching and snagging when attempting to cut through either loop pile carpeting or woven carpeting.

SUMMARY OF THE INVENTION

In accordance with the present invention, several modifications have been made to the tool of the Scott et al. patent to obviate its shortcomings. Specifically, in accordance with the present invention, the blade notch is at a much shallower angle with respect to the longitudinal edge of the tool's guide plate. Instead of a 30° angle as in the Scott et al. device, in the present invention, the angle is between 15°–25°. This shallower angle results in a much smoother cut edge, even with lightweight polyurethane back carpets. Moreover, by decreasing the angle of inclination of the cutting blade slot, less force on the handle is required to advance the cutting tool through the backing material, reducing operator effort.

Furthermore, in accordance with the present invention, there is provided a three-blade cavity or blade notch allowing an operator to cut to the right, cut to the left or cut dead center in the row between adjacent tufts.

We have also determined that by slightly altering the 90° angle between the leading edge of the guide plate and its longitudinal, carpet engaging edge, such as by having an angle in a range of from 80°–86° and with a smaller radius at the edge intersection, the improved cutter of the present invention does not catch on loop carpeting or on woven carpeting, nor does it jump out of the row where the cut is being made.

DESCRIPTION OF THE FIGURES

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
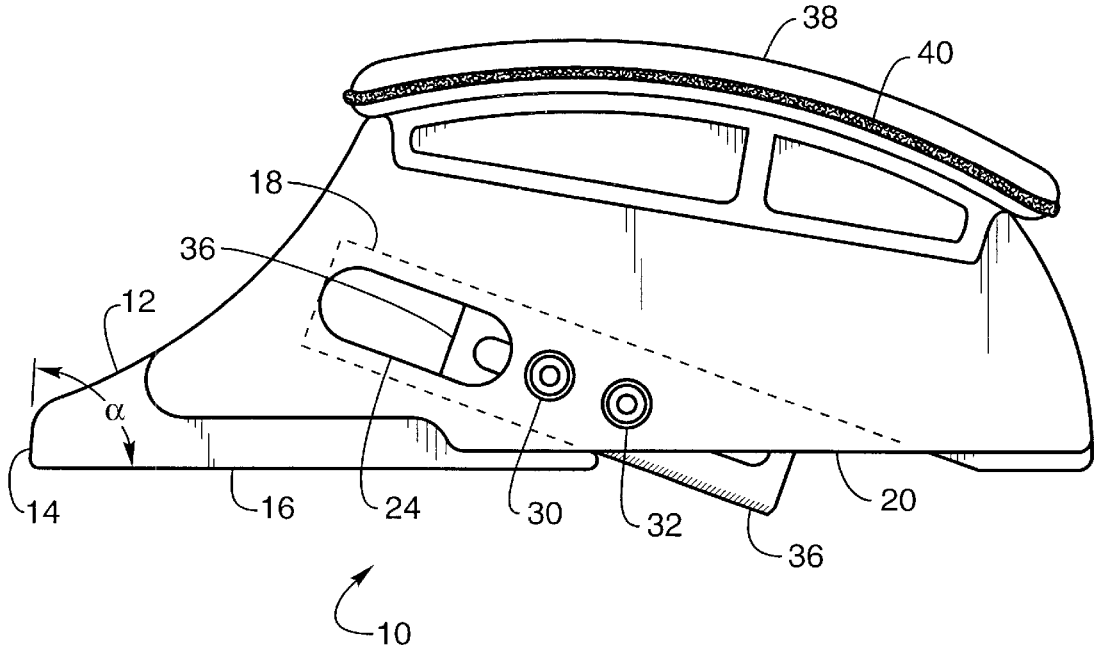
FIG. 1 is a front plan view of the improved carpet cutting tool comprising a preferred embodiment of the present invention.
Figure 2:
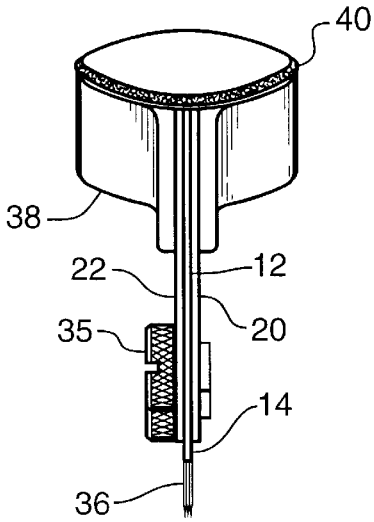
FIG. 2 is a front end view of the device of FIG. 1.
Figure 3:
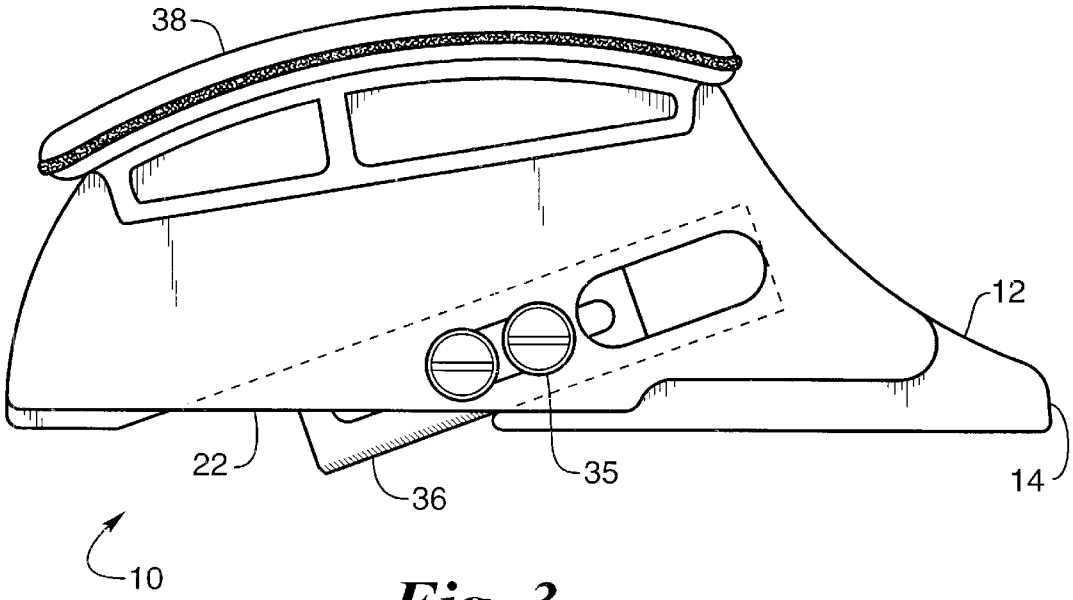
FIG. 3 is a rear view of the cutter.

Referring to the drawings, there is indicated generally by numeral 10 a cushion back carpet cutting device constructed in accordance with the present invention. It is seen to comprise a center guide plate 12 preferably made of stainless steel. It may be about 0.042 inches (in.) in thickness.

Figure 4:
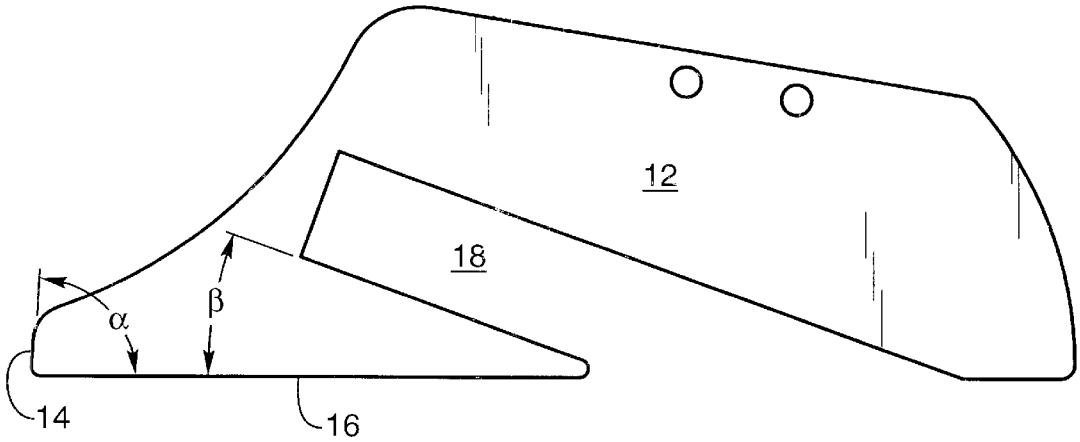
FIG. 4 is a side elevation of the center guide plate component of the carpet cutter.

As shown in FIG. 4, the center guide plate 12 has a leading edge 14 that intersects with a longitudinally extending, carpet engaging edge 16. The leading edge 14 is at a predetermined angle, a, to the carpet engaging edge 16 that is preferably in a range of from about 80°–86°. We have discovered that by providing such an acute angle, $\alpha$, and by providing a radiused intersection of about 0.06 in. between the leading edge 14 and the carpet engaging edge 16, the center guide plate 12 of the cutter 10 can be used to open a row of tufts in the carpeting and that the user need not resort to the use of a separate tool for performing this function. Moreover, we have also found that by sloping the leading edge 14 slightly from the vertical and providing the aforementioned radius at its intersection with the longitudinally extending carpet engaging edge 16, the tendency of the cutter to snag loop or woven pile carpeting or leave the selected row is practically eliminated.

As shown in FIG. 4, the center guide plate 12 further includes a generally rectangular blade notch 18 formed through its thickness dimension. The blade notch 18 is designed to intersect the carpet engaging edge 16 at an angle, β, that lies in a range of from about 15°–25°, rather than 30°–40° as in the carpet cutter of the afore-referenced Scott et al. patent.

The center guide plate 12 is sandwiched between a left side plate 20 and a right side plate 22. An elongated slot 24 having rounded ends is formed through the thickness dimension of the left side plate 20 and longitudinal sides thereof are at the same angle, β, as the blade notch 18 in the center guide plate 12. Also formed through the thickness dimension of the left side plate 20 are first and second circular apertures 26 and 28 and fitted into those apertures are internally threaded studs 30 and 32 (FIG. 1). The left and right side plates 2Q and 22 may also be stainless steel, and approximately 0.048 in. in thickness.

Figure 5:
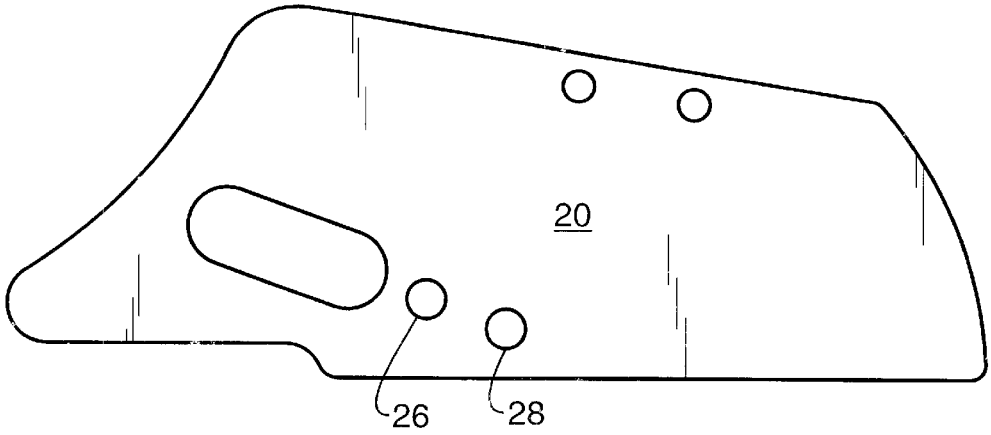
FIG. 5 is a side elevation of its left side plate.
Figure 6:
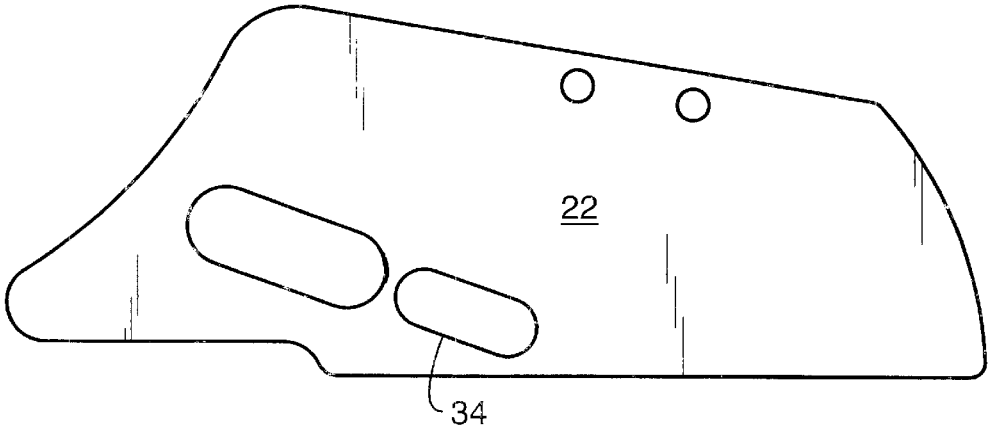
FIG. 6 is a side elevation of its right side plate.
Figure 7:
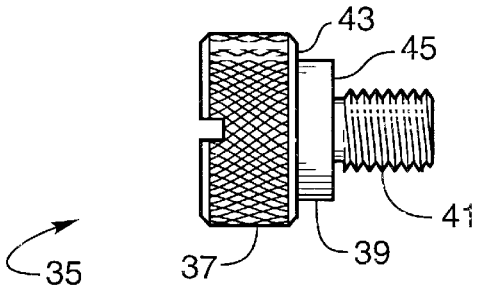
FIG. 7 illustrates a greatly enlarged view of the locking screw used to secure the cutting blade within the cutting tool.

The right side plate 22 shown in FIG. 6 is of a complimentary shape to the left side plate 20 of FIG. 5, but instead of having circular apertures like 26 and 28 on the left side plate 20, it has a second slot 34 with rounded ends for receiving blade locking screws therethrough, which engage the internal threads of the studs 30 and 32. The blade locking screw 35 is shown in FIG. 7. It includes a knurled head 37 to facilitate gripping and a stepped shoulder 39 of a lesser diameter leading to an externally threaded stem 41. When the stem 41 is screwed into one of the internally threaded studs or pem nuts 30,32, the surface 43 on the knurled head 3 7 presses against the right side plate 22 to compress it against the slotted blades while surface 45 presses against the slotted blade itself to provide double locking thereof and preventing the blade from sliding back into the blade notch 18 in the center guide plate 12.

The left and right side plates 20 and 22 and the center guide plate 12 are laminated by being spot-welded together to form the sandwich construction. The thickness of the center guide plate 12 is such that when so laminated, the blade notch 18 has sufficient width to receive three standard slotted blades, as at 36, therein in a side-by-side stacked configuration.

Injection molded onto a top portion of the laminated structure is a plastic handgrip member 38. It has a smooth rounded top surface conforming to the palm of a user's hand. Fitted into grooves or channels formed inwardly from side edges thereof are strips of elastomeric material exhibiting a high coefficient of friction: These strips are identified by numeral 40 and may preferably comprise Neoprine® rods that frictionally fit within the grooves in the handle, but which protrude slightly therefrom to help prevent slippage of the tool in the user's hand even if moist from perspiration.

Operation

In operation, the carpet installer will loosen the blade locking screws 35 and select either the left hand slotted blade, the right hand slotted blade or the center slotted blade and extend same below the level of the carpet engaging edge 16 of the cutter's center guide plate 12, with the degree of extension being determined by the thickness of the carpeting to be cut. When the leftmost blade is selected as the center guide plate 12 passes down a row between adjacent tufts, the cut will be made closely adjacent the row of tufts on the left side of the cutter. When the rightmost blade is extended, then the cut takes place closely adjacent the rightmost row of tufts. When the center cutting blade is selected, the cut through the backing material takes place midway between adjacent rows of tufts. Irrespective of which of the blades is selected by extending it beyond the carpet-engaging edge 16 of the center guide plate 12, it is held fixed in position by tightening the blade locking screws 35.

By reducing the angle between the cutting edge of the slotted blade 36 with respect to the carpet engaging edge 16 of the center guide plate 12, significantly less force is required to advance the cutter along a row defined by adjacent tufts on both cushion back carpeting and hard back carpeting, such as Action Boc® carpeting, jute back, unitary or hot melt, further, there is less tendency for the foam backing to undergo compression distortion, pucker and tear as the cutter is drawn across it, leaving a smooth edge so that two carpet segments can be brought together to form a seam that is unnoticeable.

Also, by providing a slightly acute angle, a, between the guide plate's leading edge 14 and its carpet engaging edge 16 and a small radius at their intersection, a separate row opener tool is not required to create a starting point in a row in that the nose of the center guide plate 12, or leading edge 14, can perform that function.

What is claimed is:

1. A cushion back carpet cutting tool comprising:

(a) a center guide plate of substantially uniform thickness having a leading edge for separating carpet tufts and a longitudinally extending carpet engaging bottom edge for sliding on a carpet backing, the bottom edge intersecting the leading edge at an acute angle for opening rows of tufts in carpeting, and having a generally rectangular blade notch therein, said blade notch being disposed at a predetermined angle to and intersecting said carpet engaging edge;

(b) two side plates of substantially uniform thickness that are respectively disposed on left and right sides of and rigidly attached to said center guide plate, and said side plates spanning said blade notch;

(c) three blades disposed in said blade notch in side-by-side relation and moveable, the combined thickness of said blades being slightly less than the thickness of said center guide plate, each of said blades having a longitudinal cutting edge thereon, said cutting edges being disposed along the lower edge of said blade notch, the length of such blades being substantially less than the length of said blade notch to permit retraction of said blades completely into said blade notch from extended positions where the outer ends of said blades project beyond said carpet engaging edge;

(d) adjustable retaining means for retaining said blades in said blade notch in any desired position relative to each other and relative to said carpet engaging edge; and (e) a handgrip member that is attached to at least one of said plates.

2. The cushion back carpet cutting tool as set forth in claim 1 wherein the thickness of said center guide plate is about 0.042 inches.

3. The cushion back cutting tool as set forth in claim 1 wherein said predetermined angle at which said leading edge and said longitudinal extending carpet engaging bottom edge intersect is in a range from about 80–86 degrees.

4. The cushion back cutting tool as set forth in claim 1 wherein said intersection of said leading edge and said longitudinal extending, carpet engaging bottom edge is rounded with a radius of curvature of about 0.06 inches.

5. The cushion back cutting tool as set forth in claim 1 wherein said predetermined angle at intersection of said blade notch and said carpet engaging bottom edge is in a range from about 15–25 degrees.

6. The cushion cutting tool as set forth in claim 1 wherein the thickness of said side plates is about 0.048 inches.

7. The cushion cutting tool as set forth in claim 1 wherein said handgrip member is made of plastic and is injection molded onto one or more of said plates.

8. The cushion cutting tool as set forth in claim 7 wherein said handgrip member has a smooth rounded top surface, and has grooves and channels formed inwardly from said handgrip member's side edges.

9. The cushion cutting tool as set forth in claim 1 wherein one of said side plates has an elongated slot formed through its thickness dimension with said elongated slot therein disposed to longitudinal sides thereof at the same said predetermined angle as said blade notch is to said center guide plate, and wherein the same said side plate has two apertures through its thickness dimension, and wherein fitted into said apertures in said side plate are internally threaded studs, and wherein the other of said side plates has a slot for receiving blade locking screws therethrough which engage the internal threads of said studs.

10. The cushion cutting tool as set forth in claim 9 wherein each said blade locking screw includes a knurled head and first and second stepped shoulders and an externally threaded stem, which when said externally threaded stem is screwed into one of said internally threaded studs, the first stepped shoulder while on said knurled head presses against the other said side plate to compress it against said blades and the second stepped shoulder engages the blades.

11. The cushion cutting tool as set forth in claim 9 wherein the one said side plate is the left side plate and the other said side plate is the right side plate.

12. The cushion cutting tool as set forth in claim 9 wherein said predetermined angle between said elongated slot and said longitudinal sides is in the range from about 15–25 degrees.

* * * * *